United States Patent [19]

Bass et al.

[11] Patent Number: 4,696,624

[45] Date of Patent: Sep. 29, 1987

[54] CASING PUMP

[75] Inventors: Harold E. Bass; Richard E. Bass, both of Washington, Okla.

[73] Assignee: Bassco, Inc., Washington, Okla.

[21] Appl. No.: 37,388

[22] Filed: Apr. 8, 1987

[51] Int. Cl.[4] ..... F04B 47/12; F16J 1/06

[52] U.S. Cl. ..... 417/56; 92/205

[58] Field of Search ..... 417/56–59; 92/205, 206

[56] References Cited

U.S. PATENT DOCUMENTS

| | | | |
|---|---|---|---|
| 1,421,248 | 6/1922 | Kelley | 92/206 |
| 1,805,377 | 5/1931 | Schweiger | 417/57 |
| 1,836,871 | 12/1931 | Ricker . | |
| 1,846,000 | 2/1932 | Fletcher . | |
| 1,919,547 | 7/1933 | Fletcher . | |
| 1,943,553 | 1/1934 | Ricker | 417/56 |
| 2,267,902 | 12/1941 | Eddins . | |
| 3,150,596 | 9/1964 | Knox | 417/60 |
| 4,070,134 | 1/1978 | Gramling | 417/56 |

FOREIGN PATENT DOCUMENTS

| | | | |
|---|---|---|---|
| 566760 | 1/1945 | United Kingdom | 92/205 |
| 1178979 | 9/1985 | U.S.S.R. | 417/56 |

OTHER PUBLICATIONS

Drawing of Gramling auto swab casing pump.

*Primary Examiner*—William L. Freeh

*Attorney, Agent, or Firm*—Dunlap, Codding & Peterson

[57] ABSTRACT

A well-pressure operated pump having a tubular pump body provided with an interior, annular seating surface to receive a valve member mounted on a rod extending through the seating surface. An air spring in the pump body urges the rod upwardly in response to fluid pressure in the pump body and the height of the seating surface and the position of the valve member on the rod are adjustable for adjusting the well pressure at which the valve member is seated. Seal assemblies mounted on the pump body are adjustable to match the pump to the internal diameter of the well casing and the seal assemblies are provided with retainer rings having flanges that capture end portions of a sealing member of each seal assembly. A brake, having a plate that is spring loaded to overlay a shoulder in the bore of the pump body, slows the rate of descent of the pump through gases in the well. An aspirator formed in the support for the plate holds the plate off the shoulder during passage of the pump through liquids in the well.

22 Claims, 15 Drawing Figures

CASING PUMP

BACKGROUND OF THE INVENTION

1. Field of the Invention

The present invention relates to improvements in swab-type oil well pumping apparatus of the type dropped into a well for subsequent lifting, with a charge of oil, by natural gas pressure in the well.

2. Brief Discussion of the Prior Art

In many parts of the world, oil producing formations also produce natural gas in such large quantity that the gas interferes with the pumping of wells drilled into the formations by standard down-hole pumps operated by pump jacks at the earth's surface. Because of the evolution of large quantities of gas from such a formation, oil seeping into a well is whipped into a froth that will not close check valves in the down-hole pump. To solve this problem, inventors have developed pumps which can be dropped into a well to be subsequently lifted, with a charge of oil, by natural gas pressure in the well. In particular, one type of pump that has been developed is provided with a valve that is open as the pump falls into the well and is subsequently closed by hydrostatic pressure of liquids in the well. After the valve closes, a buildup of gas pressure in lower portions of the well drives the pump and oil above the pump to the surface for discharge of oil above the pump and relief of gas pressure below the pump so that the pump can again fall into the well for another pumping operation.

While pumps of this type provide a useful way of pumping gassy oil wells, difficulties have been encountered in their use in the past. A particular difficulty that has occurred in the past is that gas pressure below the pump has not been relieved when the pump reached the earth's surface with the result that the pump has hung up in the wellhead. Not only is the pump no longer operable in such cases, but attempts to reach the pump and eliminate the stoppage can be very dangerous because of the high pressure below the pump. For example, should the wellhead be opened, the pump and a large quantity of gas might be blown out of the top of the wellhead resulting in serious injury, or the death, of the well operator.

Another problem that has been encountered with prior art pumps of this type is related to sealing between the pump and the casing of a well in which the pump is used in order that natural gas pressure below the pump can lift the pump and a charge of oil. Several problems occur with respect to seals utilized in prior art pumping devices of this type. Initially, tubing from which an oil well casing is constructed is provided in a variety of weights with each weight of a standard size tubing having a wall thickness that is varied by varying the inside diameter of the tubing. Thus, a seal that fits one weight of casing tubing will not be well matched to another weight of casing tubing so that seals for the pump cannot be standardized. Accordingly, the sealing element that engages the interior wall of the casing must be selected on a well-by-well basis. Moreover, several different weights of casing tubing may be used in one well with the result that the sealing elements on the pump cannot be well matched to a particular well.

Additionally, the sealing elements that engage the casing of a well in pumps of this type are often subject to rapid deterioration arising from several sources. One source is the initial rate of fall of the pump through a well; that is, the rate of fall of the pump at a time when the pump is above the level of liquid in the well. For the fall to occur, well fluids must pass through a bore formed through the pump body and if the bore through the pump is set to permit easy passage of the pump through liquid when it reaches lower portions of the casing, the pump can reach very high speeds while falling through gas above the liquid level in the well. This high speed fall can result in excessive wear of the sealing elements by rubbing of the elements against the inner wall of the casing. On the other hand, the provision of some means to slow the passage of the pump through gas can cause the pump to settle very slowly through liquid resulting in a loss of efficiency in the pumping operation.

Finally, a problem with seals also arises from the assembly of a casing from lengths of tubing that are connected together end-to-end by means of couplings between the ends of the individual lengths of tubing. This manner of forming the casing results in gaps between the ends of adjacent lengths of tubing which, in the past, have not only given rise to accelerated wear of the seals but, in some cases, have inverted cup-shaped elements in the seals resulting in rapid deterioration of the sealing elements.

SUMMARY OF THE INVENTION

The present invention solves these problems by providing a casing pump having a construction that ensures the release of gas pressure below the pump when the pump reaches the wellhead and by providing the pump with a brake and seal assemblies that overcome problems with seals between the pump and the casing that have occurred in the past. In particular, the present invention contemplates that closure of the pump to initiate lifting by natural gas pressure in a well will be effected at an interior, annular seating surface adjacent the upper end of the pump body by a seal member mounted on a rod that passes through the seating surface. The rod is supported within the pump body by an assembly that is responsive to pressure within the pump body for urging the rod upwardly to seat the valve element in the seating surface and the rod protrudes beyond the upper end of the pump body to be engaged by portions of the wellhead in which the pump is used when the pump reaches the earth's surface. Thus, the rod provides a direct linkage to the valve element to force the valve element from the seating surface and begin the initial release of pressure below the pump. Such release lowers the pressure within the body of the pump so that the assembly utilized to lift the rod, because of the pressure sensitive characteristics of such assembly, then contributes to the unseating of the valve element to ensure that the valve will be fully opened to relieve gas pressure below the pump.

Seal longevity is provided in the pump both by seal construction and by limiting the speed with which the pump falls through gases in the well. In order to slow the rate of descent of the pump through gas, without interfering with the settling of the pump through liquid near the bottom of the well, a brake is provided within the pump body that provides a different resistance to the flow of fluid through the pump body when the fluid is a gas than when the fluid is a liquid. In particular, the brake has a brake body mounted in the bore of the pump body above a shoulder formed in the bore and the brake body has a cavity formed in its lower end facing the shoulder. A tapered outer periphery that enlarges toward the lower end of the brake body forms an annular, constricted flow passage about the lower end of the brake body. A valve plate is mounted on the brake body and spring loaded against the shoulder to obstruct the pump body bore and prevent the rapid passage of gases through the pump body at such times that the valve plate overlays the shoulder. Thus, the rate of descent of the pump is limited by the rate at which gases can escape past the valve plate. When the pump reaches liquid in the well, the initial shock delivered to the valve plate by entry of liquid into the pump body bore drives the valve plate to a position overlaying the cavity in the brake body so that liquid can flow through the pump body bore and, in particular, through the annular passage about the lower end of the brake body. Grooves are formed at the lower end of the brake body, between the cavity therein and the annular passage, so that, once liquid begins to flow through the annular passage, suction is created within the cavity in the lower end of the brake body to maintain the valve plate against the lower end of the brake body for easy passage of liquid through the pump body and, consequently, easy passage of the pump body through liquid in the well.

The pump of the present invention also includes seal assemblies in which the elastomeric member that engages the interior of the casing is securely fixed at both ends and has an adjustable outer diameter permitting the mating of a seal assembly having a sealing member of one size to any well having casing of a selected nominal size; that is, to casing in which the inside diameter varies due to differences in wall thicknesses of the casing. To these ends, the pump of the present invention is provided with seal assemblies which each comprise an elastomeric sealing member having end portions that are encircled by flanges formed on retainer rings that are held in position at the ends of the seal assembly. The central portions of the sealing members bulge radially outwardly to form a cavity within the sealing member and an adjustment ring is located in the cavity to bear against the ends of the sealing member, thereby securing the sealing member about the pump body. Each adjustment ring is formed of two tubular elements so that the length of the adjustment ring can be varied to vary the separation of the end portions of the sealing member and thereby vary the outside diameter of the sealing member to match the seal assemblies to the casing of the well in which the pump is used.

An object of the present invention is to provide a casing pump of the type operated by natural gas pressure in a well that ensures release of gas pressure below the pump when the pump reaches the wellhead.

Another object of the invention is to provide a casing pump with a differential brake that prevents the pump from falling at an excessive speed through gas in upper portions of the well without interfering with the rate at which the pump settles in liquid at the lower end of the well.

Another object of the invention is to provide a casing pump with seal assemblies that can be adjusted to mate to the well in which the pump operates.

Another object of the invention is to increase the lifetime of sealing members utilized to form a seal between the body of a casing pump and a casing in which the pump is used.

Other objects, advantages and features of the present invention will become clear from the following detailed description of the pump when read in conjunction with the drawings and the appended claims.

BRIEF DESCRIPTION OF THE DRAWINGS

FIG. 6 is a transverse cross section of the pump taken along line 6—6 of FIG. 5.

DESCRIPTION OF FIGS.1-9

Figure 1:
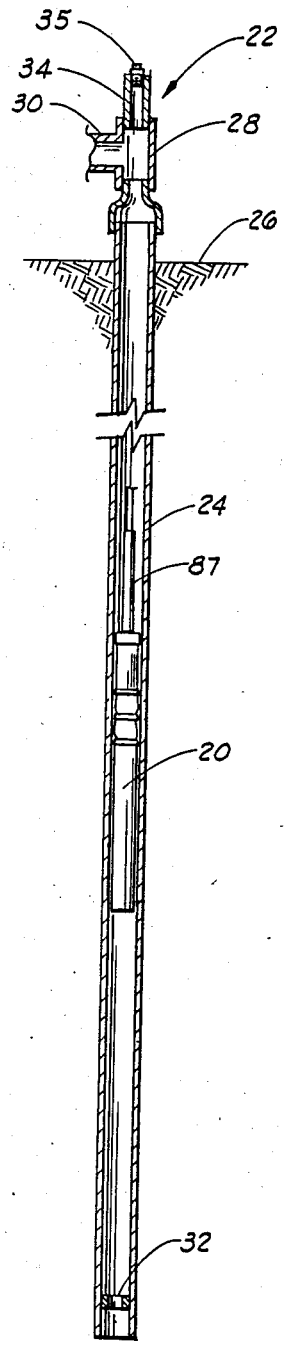
FIG. 1 is a cross section in side elevation of a well containing a pump constructed in accordance with the present invention.

Referring now to the drawings in general and to FIG. 1 in particular, shown therein and designated by the general reference numeral 20 is a casing pump constructed in accordance with the present invention. During use, and as shown in FIG. 1, the casing pump 20 is located within a well 22 generally comprised of a casing 24 that extends downwardly from the earth's surface 26 and is surmounted by a removable wellhead 28 having a lateral collection pipe 30 from which oil produced by the well is discharged to a battery of collection tanks. A stop 32 is mounted in lower portions of the casing 24 to limit downward movement of the pump 20 and the wellhead 28 can be provided with a catcher (not shown) mounted on a catcher block 34 at the top of the wellhead 28. (A suitable stop and manner of mounting the stop in the casing is disclosed in U.S. Pat. No. 4,070,134, issued Jan. 24, 1978 to Gramling.) Preferably, a threaded axial bore is formed through the end of the catcher block 34 to receive a plug 35 for a purpose to be discussed below.

Figure 2:
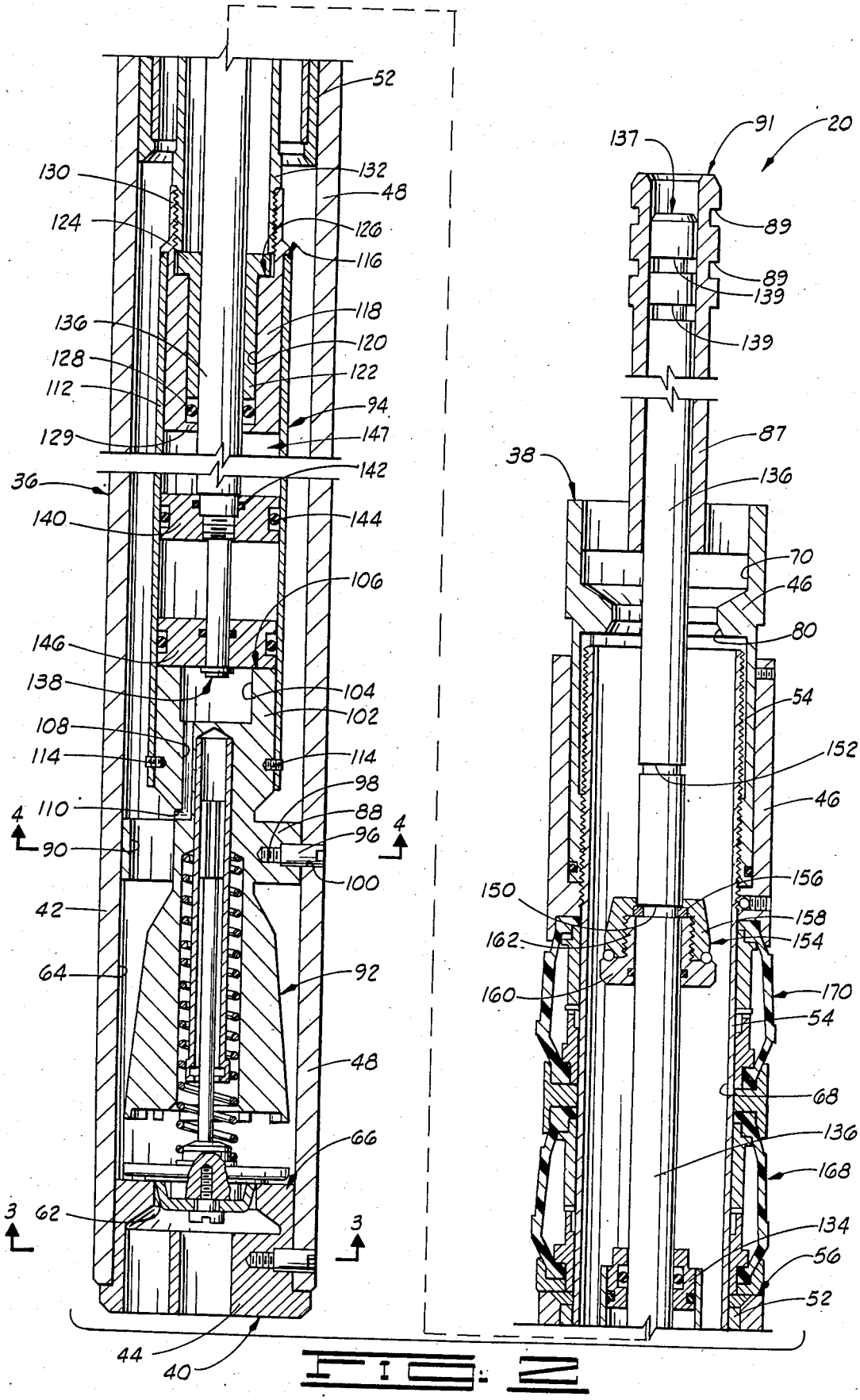
FIG. 2 is an elevational cross section of the pump shown in FIG. 1.

Turning now to FIG. 2, the casing pump 20 is generally comprised of a tubular pump body 36 having an upper end 38 and a lower end 40. Both the upper end 38 and the lower end 40 have openings therein so that fluids in the well 22 may pass through both the upper end 38 of the pump 20 and the lower end 40 thereof.

Figure 3:
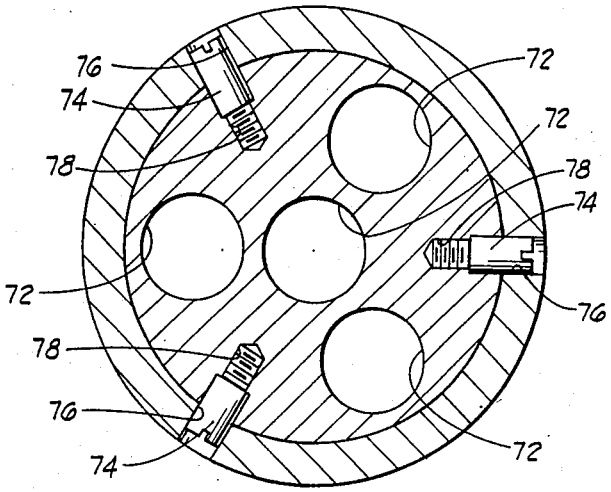
FIGS. 3 and 4 are transverse cross sections, on an enlarged scale, taken along lines 3—3 and 4—4 of FIG. 2, respectively.
Figure 5:
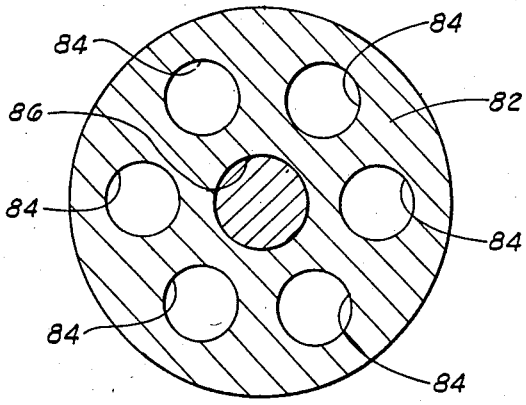
FIG. 5 is an enlarged elevational cross section of upper portions of the pump shown in FIG. 1.

In the preferred embodiment of the pump 20, the pump body 36 is comprised of a tubular base member 42 that extends upwardly from the lower end 40 of the pump body 36 to a position near the upper end 38 of the pump body 36, a body plug 44 mounted in the base member 42 at the lower end of the pump body 36, and a tubular cap 46 that is mounted over upper portions of the tubular base member 42. The base member 42 is conveniently constructed in three parts that are welded together as has been illustrated in FIG. 2. From the lower end of the pump body 36 the base member is comprised of a tubular barrel 48 that extends to a medial portion of the pump body 36, a ring 52 welded inside the upper end of the barrel 48 and a tubular extension 54 that is welded inside the ring 52 and extends upwardly from the barrel 48 so that an upwardly facing shoulder 56 is formed on medial portions of the base member 42. As shown in FIG. 5 in which upper portions of the pump body 36 have been reproduced on an enlarged scale, upper portions of the tubular extension 54 are externally threaded and the cap 46 is provided with internal threads 58 adjacent an annular lower end 60 thereof so that the cap 46 can be screwed onto the upper end portions of the base member 42. Returning to FIG. 2, the body plug 44 has an axial bore 62 that is formed on a diameter smaller than the diameter of the bore 64 of the barrel 48 to form an upwardly facing, internal, annular shoulder 66 in the bore of the pump body 36 formed by the bores 62 and 64 and the bores 68 and 70 of the tubular extension and cap 46, respectively. As shown in FIG. 3, lower portions of the body plug 44 are provided with a plurality of axially extending holes 72 that provide for fluid communication between the well and the interior of the pump body 36 at the lower end of the pump body 36. The body plug 44 can be conveniently mounted in the lower end of the barrel 48 via screws 74 that pass through holes 76 formed through the barrel 48 and are screwed into threaded blind holes 78 formed in the body plug 44. An internal shoulder (not numerically designated in the drawings) is formed in each of the holes 78 so that portions of the screws 74 will extend into the holes 76 and secure the body plug 44 to the barrel 48.

As shown in FIG. 5, a downwardly opening seating surface 80 is formed about the inner periphery of the cap 46 so that the bore of the pump body 36 can be closed to fluid flow in a manner to be discussed below. It will be noted that the mounting of the cap 46 on the base member 42 via the threads on the tubular extension 54 and inside the cap 46 permits the seating surface 80 to be positioned at various heights with respect to the base member 42 for a purpose also to be discussed below. As shown in FIGS. 2, 5 and 6, the upper end of the cap 46, at the upper end 38 of the pump body 36, has the form of a plate 82 through which a plurality of axial bores 84 are formed to provide fluid communication between the interior of the pump body 36 and the well 22 at the upper end 38 of the pump body 36. A central bore 86 is formed through the plate 82 and a guide tube 87 is formed integrally with the cap 46 to protrude upwardly therefrom as illustrated in FIGS. 1 and 2. Circumferential grooves 89 adjacent the upper end 91 of the guide tube 87 are provided to permit the pump 20 to be caught by a catcher in the wellhead 28 and to provide a purchase on the guide tube 87 should it become necessary to fish the pump 20 from the well 22.

Figure 4:
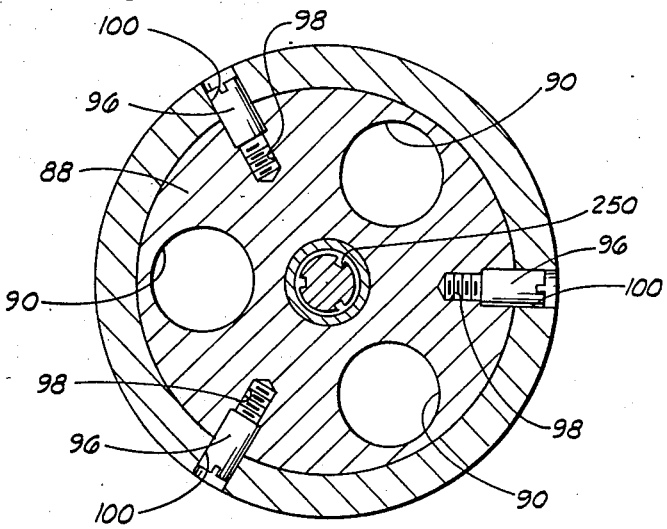

Referring to FIGS. 2 and 4, a circular support 88 having axially extending bores 90 formed therethrough is mounted in the bore 64 of the barrel 48 a distance above the shoulder 66 to support a brake assembly 92 above the shoulder 66 and an air spring 94 that extends upwardly through the barrel 48 to a level near the shoulder 56. As shown in FIG. 4, the support 88 is mounted in the barrel 48 via screws 96 that extend into shouldered, blind, threaded holes 98 in the support 88 and extend outwardly into holes 100 formed through the barrel 48.

Referring first to the air spring 94 and with reference to FIG. 2, such spring includes a cylindrical base 102 that is formed integrally with the support 88 and has a cylindrical cavity 104 formed in the upper end 106 thereof. A passage 108 extends downwardly from the cavity 104 and has a bend 110 at the support 88 that opens to the bore 64 of the barrel 48 so that well fluids entering the lower end 40 of the pump body 36 can be transmitted to the cavity 104. Lower portions of a cylinder 112, of which the air spring is comprised, are secured about the base 102 via screws 114 and the cylinder 112 extends coaxially to the barrel 48 to a position a distance below the ring 52 as shown in the center drawing of FIG. 2. At its upper end 116, the cylinder 112 receives a tubular bearing support 118, welded to the upper end 116 of the tube 112, the bearing support 118 having a bore 120 in which is mounted a plastic bearing and seal retainer 122. The bearing and seal retainer 122 has a flange 124 that sits on a shoulder 126 formed in the bearing support to limit the extension of the bearing and seal retainer ring 122 into the bore 120 of the bearing support 118 and an O-ring 128 is mounted within the bore 120 between the lower end of the bearing and seal retainer 122 and an internal flange 129 formed on the bearing support 118.

At its upper end, the bearing support 118 has a tubular extension 130 into which is screwed a tube 132 containing a tubular piston 134 in upper portions thereof. The piston 134 has smooth inner and outer peripheries for sliding movement within the tube 132 and the interior of the tube 132 is packed with grease to prevent, with O-rings in the peripheries of the piston 134, the entry of grit and the like from the well into the bearing and seal retainer ring 122.

A rod 136 has a lower end 138 located within the cylinder 112 of the air spring 94 and the rod 136 extends upwardly through the bearing and seal retainer 122, the seating surface 80, and the guide tube 87 formed integrally with the cap 46 to an upper end 137 located a distance above the upper end 38 of the pump body 36. Circumferential grooves 139 near the upper end of the rod 136 provide an additional purchase for fishing the pump 20 from the well should it become necessary to do so. Upper portions of the rod 136 are thus supported by the guide tube 87 and lower portions thereof by the bearing and seal retainer 122 so that the rod 136 is positioned with respect to the pump body 36 for axial movement through the seating surface 80. (Additional support for the rod 136 is provided by pistons in the air spring 94 as will be discussed below.) The length of the guide tube 87 is selected such that, at such times that the lower end 138 of the rod 136 is substantially even with the upper end 106 of the base 102 of the air spring 94, the upper end of the rod 136 is substantially even with the upper end of the guide tube 87. Thus, a rise in the level of the rod 136 will extend the rod 136 from the guide tube 87.

A piston 140, having O-ring seals 142 and 144, providing seals with the rod 136 and the inner periphery of the cylinder 112, and a partially threaded bore, is screwed onto a threaded portion of the rod 136 near the lower end 138 thereof and a second piston 146, free to slide on lower portions of the rod 136, is mounted on the rod 136 below the piston 140 to provide a space between the pistons 140 and 146 that can be filled with grease to prevent grit from the well from reaching the seals on the piston 140 and interfering with free sliding movement of the rod 136 in the air spring 94. A conventional clip adjacent the lower end 138 of the rod 136 secures the piston 146 on the rod 136. Portions of the cylinder 112 of the air spring 94 between the upper piston 140 on the rod 136 and the seal 128 in the bore of the bearing support 118 form an air chamber 147 in which air can be compressed by fluid pressure transmitted via the passage 108 to the pistons 140 and 146. Thus, fluid pressure in the pump body 36 can drive the rod 136 upwardly in proportion to pressure in the well transmitted into the bore of the pump body 36 via the passages 72 formed through the body plug 44.

As shown in FIG. 2, the two circumferentially extending grooves 150 and 152 are formed in portions of the rod 136 located below the seat 80 formed in the cap 46 for mounting a valve member 154 on the rod 136 as shown in the center drawing of FIG. 2 wherein the valve member 154 is shown mounted about the groove 150. To this end, the groove 150, or the groove 152, receives a split ring 156 and the valve member is comprised of a tubular upper section 158 having a radially inwardly extending flange (not numerically designated in the drawings) to engage the upper side of the split ring 156. The valve member 154 is further comprised of a tubular lower section 160 that slides on the rod 136 and has an upwardly extending portion 162 that engages the lower side of the split ring 156. The portion 162 of the lower section 160 is externally threaded and the bore of the upper section 158 is threaded so that the two sections 158 and 160 can be screwed together about the split ring 156 to mount the valve member 154 on the rod 136. As particularly shown in FIG 5, the lower section 160 of the valve member 154 has a seating surface 164 formed on its outer periphery to mate with the seating surface 80 in the cap 46 of the pump body 36. Grooves (not numerically designated in the drawings) are formed in the sections 158 and 160 to support an O-ring 166 immediately above the seating surface 164 to provide a tight seal between the valve member 154 and the cap 46 at such times that the seating surfaces 80 and 164 are forced into contact.

As noted above, the rod 136 rises in response to fluid pressure within the pump body 36 until the valve member 154 closes the bore 70 of the cap 46 by engagement of the seating surface 80 with the seating surface 164. Moreover, the amount by which the rod 136 is raised by well fluids that enter the pump body 36 is proportional to the fluid pressure within the pump body 36. Thus, the above-noted screw connection of the cap 46 and base member 42 provide one means of adjusting the pressure at which the bore through the pump body 36 is closed. Similarly, the provision of the rod 136 with a plurality of grooves 150 and 152 for mounting the valve member 154 on the rod 136 provides a second means of adjusting the fluid pressure in the pump body 36 at which the valve formed by the valve member 154 and the seating surface 80 closes. It is contemplated that, in the use of the casing pump 20, the groove upon which the valve member 154 is mounted will be selected to provide a rough adjustment of the pressure at which the pump body bore is closed and the cap 46 will then be adjusted on the base member 42 to provide a fine adjustment of the pressure at which closure of the pump body bore occurs.

Figure 7:
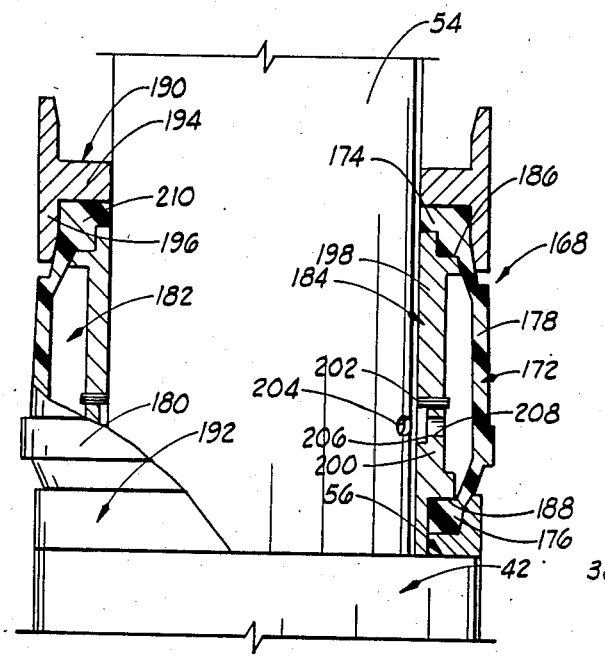
FIG. 7 is an enlarged side elevation in partial cross section of a seal assembly of the pump shown in FIG. 1.

Referring once again to FIG. 2, the casing pump 20 is further comprised of two seal assemblies 168 and 170 that slide on the tubular extension 54 of the base member 42 and are supported in the assembled pump by the shoulder 56 at the upper end of the barrel 48 of the base member 42. For purposes of illustration, the seal assembly 168 has been illustrated on an enlarged scale in FIG. 7. As shown therein, the seal assembly 168 is comprised of a tubular, elastomeric seal member 172 having spaced apart, circular end portions 174 and 176 that extend in a circle about the tubular extension 54. The end portions 174 and 176 are connected by a tubular central portion 178 upon which is formed a seating surface 180 to engage the inner periphery of the casing 24 at such times that the casing pump 20 is disposed in the well 22. As can be seen in FIG. 7, the central portion 178 of the seal member 172 is provided with an outward bulge to form an annular cavity 182 that extends within the seal member 172 about the extension 54 of the base member 42 and the seal assembly 168 further comprises a seal adjustment ring 184, constructed of steel or other rigid material, which is located within the cavity 182 to extend about the extension tube 54. The ends of the seal adjustment ring 184 are provided with shoulders 186 and 188 to engage the end portions 174 and 176, respectively, of the seal member 172 and the seal assembly 168 is further comprised of two retainer rings 190 and 192, each having a radially annular portion 194 and a tubular flange 196 as shown in FIG. 7 for the seal retainer ring 190. (As shown in the drawings, the upper seal retainer ring of the seal assembly 168 can be formed unitarily with the lower seal rtainer ring of the seal assembly 170.) The flange 196 of each retainer ring encircles the end portion of the seal member 172 adjacent the retainer ring to capture the end portions of the seal member 172 between the flanges of the retainer rings and the ends of the seal adjustment ring at such times that the seal assembly 168 is assembled on the extension 54 as illustrated in FIG. 7.

One aspect of the present invention is that the construction of the seal assemblies 168 and 170 provides for adjustment of the diameter of the seating surfaces 180 thereon that engage the interior of the casing 24. To this end, the seal adjustment ring 184 of each seal assembly is split into two coaxial elements 198 and 200 that can be spaced apart to space the distance between the end portions 174 and 176 of the seal member 172 by means of annular spacers 202 postioned between abutting ends of the elements 198 and 200 of the seal adjustment ring 184.

It is further contemplated that seating surfaces 180 of the seal members 172 of each seal assembly be held firmly in engagement with the wall of the casing 24 during operation of the pump 20 and, for this purpose, fluid pressure within the pump body 36 is transmitted to the interiors of the cavity 182 in the seal assemblies 168 and 170. To this end and as shown for the seal assembly 168, holes 204 are formed through the tubular extension 54 at a level with the lower element 200 of each seal adjustment ring 184 and a groove 206 is formed about the inner periphery of each element 200 at a level with a hole 204. A hole 208 through the element 200 intersecting the groove 206 and opening to the cavity 182 then transmits fluid pressure from the interior of the tubular extension 54 to the cavity 182. In order to provide a seal between the seal member 172 and the tubular extension 54, the end portion 174 of the seal member 172 is provided with an inwardly extending flange 210 that engages the periphery of the extension 54.

Figure 8:
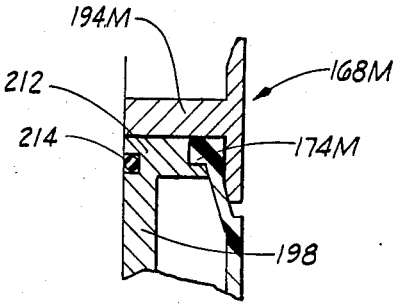
FIG. 8 is a fragmentary cross section in side elevation of a modified seal assembly.

FIG. 8 illustrates a modification, designated 168*m* of the seal asembly 168 that permits the pump 20 to be used in casing having a larger nominal diameter than casing in which the pump provided with seal assemblies 168 and 170 would be used. In the seal 168*m*, both elements of the seal adjustment ring are provided with flanges at the ends of the seal adjustment ring as has been shown at 212 for the element 198*m*. Similarly, the retainer rings have a widened annular portion 194*m* so that the end portions of the seal member, as shown for the end portion 174*m* in FIG. 8, can again be captured between the end of an element of the seal adjustment ring and a retainer ring. Sealing between the seal assembly 168*m* and the tubular extension 54 is effected by an O-ring 214 mounted in a groove formed in the inner periphery of the element 198*m* of the seal adjustment ring.

The seal assembly 170 differs from the seal assembly 168 in that the lower retainer ring of the seal assembly 170 is formed unitarily with the upper retainer ring of the seal assembly 168 and, further, the upper retainer ring of the seal assembly 170, designated 191 in FIG. 5, has a modified construction that is utilized to fix the position of the cap 46 on the tubular extension 54. In particular, the retainer ring 191 has an upwardly extending tubular portion 216 that fits about lower portions of the cap 46 and which can be secured to both the cap 46 and the tubular extension 54 of the base member 42. To this end, a threaded hole 218 is formed through the tubular portion 216 near the upper end thereof to receive a set screw 220 that bears against the outer periphery of the cap 46 to fix the cap against rotation in the tubular portion 216 and a threaded hole 222 is formed radially through the annular portion of the retainer ring 191 to receive a set screw 224 and a nylon ball 226 that can be jammed against the threads of the tubular extension 54 by the set screw 224 to fix the retainer ring 191 against rotation on the base member 42 of the pump 20. In order that the cap 46 be adjustable on the base member 42 and that, at the same time, the seal assemblies be maintained in the assembled condition shown in the drawings, the pump 20 also comprises a spacer ring 228 that is mounted on the tubular extension 54 immediately below the annular surface 60 of the cap 46 to rest on the annular portion of the retainer ring 191 and the length of the spacer ring 228 is selected with respect to the position of the cap 46 on the base member 42 such that the combined lengths of the seal assemblies and the spacer ring 228 is equal to the distance between the annular surface 60 and the shoulder 56. Thus, adjustment of the level of the seating surface 80 to adjust the pressure in the pump body 36 at which the bore therethrough closes can be effected without loss of the secure capture of the end portions of the sealing members of the seal assemblies by the retainer rings and the seal adjustment rings of the seal assemlies.

Figure 9:
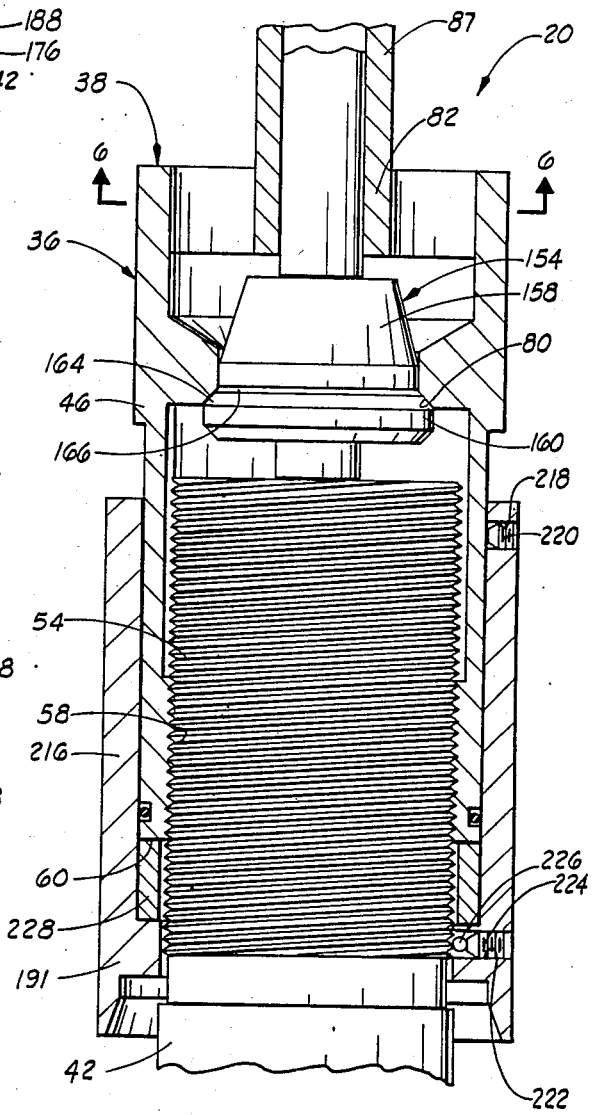
FIG. 9 is a side elevation in partial cross section of the brake of the pump shown in FIG. 2.
Figure 9:
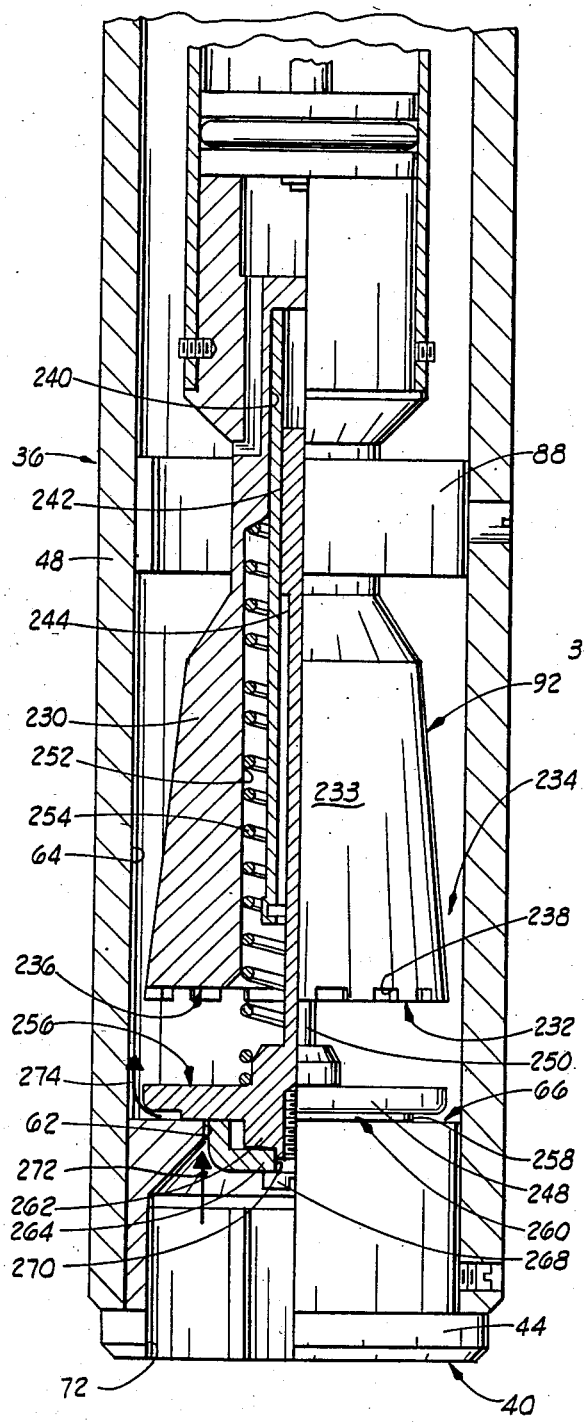

Referring now to FIG. 9, the brake assembly 92 is comprised of a brake body 230 that is formed integrally with the support 88 and extends downwardly therefrom to a lower end 232 positioned above the shoulder 66 in the bore of the pump body formed by the bores 62 and 64 of the body plug 44 and barrel 48, respectively. The brake body 230 has a tapered peripheral surface 233 that widens toward the lower end 232 so that an annular passage 234 is formed between the periphery 232 and the bore 64 of the barrel and, further, so that a restriction is formed in the annular passage 234 at the lower end 232 of the brake body 230. A cavity 236 is formed in the lower end 232 of the brake body 230 and a plurality of radially extending grooves 238 are formed in the lower end 232 of the brake body 230 to provide fluid communication between the cavity 236 and the passage 234 at the restriction in the passage 234. A blind bore 240 is formed upwardly from the cavity 236 through the brake body 230, the support 88 and the base 102 of the air spring and a guide tube 242 is pressed into the bore 240 to receive the cylindrical stem 244 of a brake valve 246 utilized to cause a high resistance to fluid passage through the casing pump at such times that the casing pump 20 falls through gases in the well 22. The brake valve 246 is further comprised of a valve plate 248 that is formed integrally with the valve stem 244, at the lower end of the valve stem 244, so that the valve plate is located between the lower end 232 of the brake body 230 and the shoulder 66 in the bore of the pump body. The diameter of the valve plate is selected to be substantially equal to the diameter of the lower end of the brake body and the bore 62 through the body plug 44 is formed on a diameter such that the valve plate 248 will overlay the bore 62 at such times that the stem 244 is displaced downwardly within the guide tube 242 a distance sufficient for the valve plate 248 to engage the shoulder 66. In order that the stem slides freely within the guide tube 242, lower portions of the stem are formed on a reduced diameter and grooves 250 are formed the length of upper portions of the stem as shown in FIGS. 2 and 4. A counterbore 252 is formed in the bore 240 to extend upwardly from the cavity 236 and receive a spring 254 that extends about the guide tube 242 and engages the upper side 256 of the valve plate 248 to urge the valve plate 248 against the shoulder 66. As will be discussed below, the valve plate 248 is utilized to slow escape of gases through the pump body 36 and the construction of the valve plate 248 permits adjustment of the extent to which escape of gases thereby is effected. In particular, a shoulder 258 is formed on the underside 260 of the valve plate 248 to adjust the area of contact between the valve plate 248 and the shoulder 66. Additionally, further control of the rate of passage of gas by the valve plate 248 is effected by forming a circular extension 262 on the underside 260 of the valve plate 248 for mounting of a cup 264, having a downwardly tapering outer periphery formed on a diameter differing only slightly from the diameter of the bore 62, on the underside of the valve plate 248 to enter the bore 62 when the plate 248 engages the shoulder 66. To ensure that the cup 264 will enter the bore 62, the cup 264 is mounted to the valve plate 248 via a screw 268 that passes through an oversized hole 270 formed through the bottom of the cup 264.

Operation of the Casing Pump

In describing the operation of the casing pump 20, it will be useful to consider a complete cycle of operation of the pump 20 beginning at a time that the pump 20 is at the top of the well 22 following release of gas pressure from below the pump 20 so that the pump 20 will begin to fall in the well. As will become clear from the description of the manner in which release of gas pressure below the pump 20 is effected, the valve member 154 on the rod 136 will be displaced downwardly from the seating surface 80 formed in the inner periphery of the pump body bore, as illustrated in FIG. 2, so that gases in the pump body above the valve plate 248 can escape freely from the openings 84 in the cap 46 via the annular passage 234 about the brake body 232, the holes 90 through the support 88, and the bores 64 and 68 of the barrel 48 and tubular extension 54, respectively. Similarly, gases may enter the bore of the pump body via the holes 72 formed through the body plug 44 at the lower end 40 of the pump body 36. Thus, the only obstruction to free passage of gases through the bore of the pump body 36 is provided by the engagement of the valve plate 248 with the shoulder 66, as illustrated in FIG. 9, under the influence of the spring 254. Accordingly, gases entering the lower end 40 of the pump body 36 will pass through the pump body but such passage will be limited to leakage about the cup 264 and between the lower side 260 of the valve plate 248 and the shoulder 66 as indicated by arrows 272 and 274 in FIG. 9. The spring constant of the spring 254 is selected such that the valve plate 248 will be only slightly lifted from the shoulder 66 with the result that a high resistance to gas passage through the bore of the pump body 36 will occur. Thus, since the seal assemblies 168 and 170 provide a seal between the exterior of the pump body 36 and the inner wall of the casing 24, gas pressure will build up below the pump 20 to slow the rate of descent of the pump 20 through the casing 24 while the pump 20 is descending through gases. Thus, the brake assembly 92 will limit the initial rate of descent of the pump 20 to consequently limit wear to the sealing members 172 of the seal assemblies 168 and 170 and thereby extend the life of the seal members 172.

Figure 10:
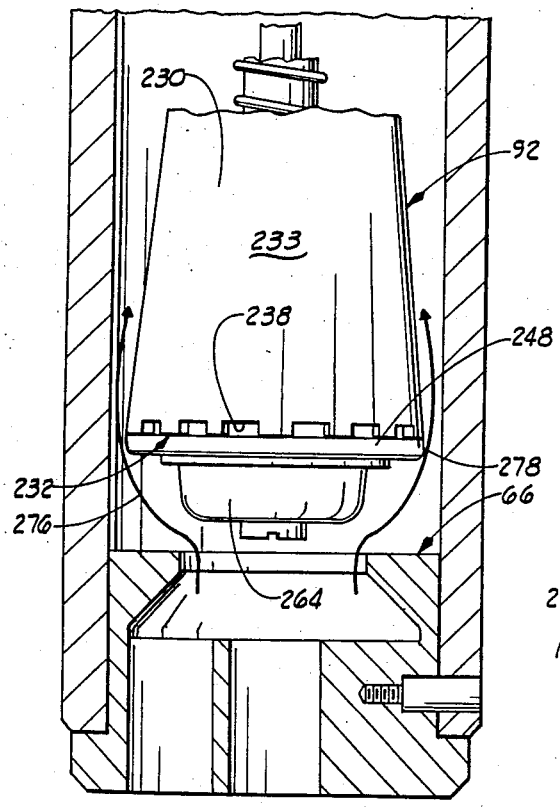
FIG. 10 is a partial side elevation of the brake shown in FIG. 8 illustrating the flow of liquid about the brake body.

When the pump descends in the casing 24 to a level at which liquid has risen in the casing 24, the liquid will enter the holes 72 and impinge upon the cup 264 and valve plate 248 to drive the valve plate 248 against the lower end 232 of the brake body 230, as shown in FIG. 10, via the initial shock of contact of the cup 264 and valve plate 248 with liquid in the well. As the valve plate 248 is driven against the lower end 232 of the brake body 230, liquid flow will be established upwardly through the passage 234 along flow lines indicated at 276 and 278 to provide a streaming of liquid through the restricted portion of the passage about the lower end 232 of the brake body 230. On the other hand, because of the radially outward position of the flow passage 234 with respect to the brake body 230, liquid immediately below the cup 264 and the valve plate 248 will be stagnant so that liquid immediately below the valve plate 248 and cup 264 will be at a higher pressure than liquid streaming through the restricted portion of the annular passage 234 about the brake body 230. Thus, suction will be created in the cavity 236 formed in the lower end 232 of the brake body 230 via the fluid communication provided between the passage 234 and the cavity 236 by the grooves 238 formed radially in the lower end 232 of the brake body 230. This suction will counteract the force of the spring 254 on the valve plate 248 so that the valve plate 248 will be maintained in contact with the lower end 232 of the brake body 230, as shown in FIG. 10, to provide an efficient rate of descent of the pump 20 through liquid in the well.

Figure 11:
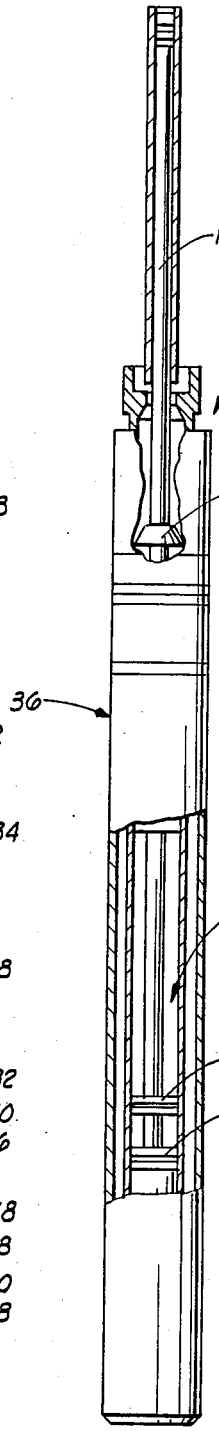
FIGS. 11 and 12 are schematic elevational views, in partial cutaway, of the pump shown in FIG. 2 illustrating the closure of the pump body bore to initiate lift of the pump by natural gas pressure.
Figure 12:
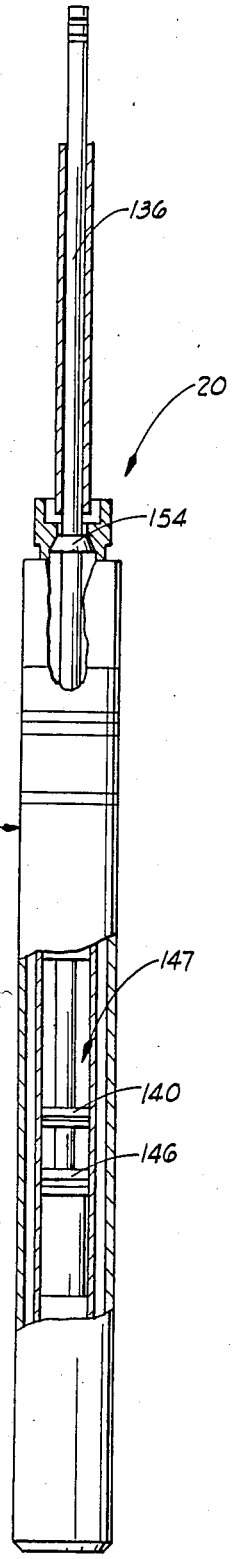

Referring now to FIGS. 11 and 12, the position of the rod 136, the valve member 154 and the pump body 36, and the position of the pistons 140 and 146 in the cylinder 112 of the air spring 94, have been illustrated for two locations of the pump 20 within liquid that has entered lower portions of the well casing 24. FIG. 11 illustrates the positions of the rod 136, valve member 154, and pistons 140, 146 as the pump 20 enters liquid, and FIG. 12 illustrates the positions of these elements of the pump 20 at such times that the pump 20 is submerged to a depth that is selectable by the choice of grooves 150 or 152, used to mount the valve member 154 on the rod 136 and by the position of the cap 46 on the tubular extension 54. At such times that the pump 20 enters liquid, air in the chamber 147 above the piston 140 will be in an expanded condition to position the rod 136 in a lowered position in which the piston 146 is seated on the base 102 of the air spring 94 with the result that the valve member 154 is displaced downwardly from the seating surface 80 (not numerically designated in FIGS. 11 and 12) formed about the inner periphery of the bore of the pump body 36. As the pump 20 sinks through liquids in the well or, should the pump fall to the stop 32, as liquids rise in the well, the hydrostatic pressure produced by the liquids above the pump 20 will be transmitted to the air spring 94 via the passage 108 (FIG. 2) formed through the base member 102 of the air spring 94. The hydrostatic pressure of the well liquids counteract downwardly acting air pressure on the piston 140 to the rod 136. When the hydrostatic pressure in the well reaches a value preselected by the positioning of the valve element 154 on the rod 136 and by the positioning of the cap 46 on the base member 42 of the pump body 36, the valve member 154 will seat in the seating surface 80 to close the bore through the pump body to further passage of liquid through the pump body and to also seal lower portions of the well below the seal assemblies 168 and 170. That is, the rod 136 and valve element 154 will now be positioned as has been illustrated in FIG. 12.

With lower portions of the well sealed by the pump 20 and with the bore of the pump closed, further entry of liquid and gases into the well 22 will lift the pump 20 and liquid thereabove as indicated by the direction arrow 280 in FIG. 1. Thus, the pump 20 will be lifted by gas pressure in the well 22 to lift a charge of oil through the casing 24 for delivery from the collection pipe 30 and lifting of the pump 20 will continue until the rod 136 enters the wellhead 28 and bears against a shoulder (not numerically designated in the drawings) formed in the catcher block 34. Further entry of fluids into the well 22 will then force the pump body 36 upwardly to lift the seating surface 80 off the valve element 154. As the valve element 154 is unseated, gases below the pump 20 are discharged through the holes 84 formed in the upper end 38 of the pump body 36 so that pressure within the pump body 36 below the pump 20 is relieved. An important aspect of the present invention is that the initial relief of pressure within the pump body 36 ensures the complete relief of pressure below the pump 20. That is, as the relief of pressure within the pump body 36 commences, air that has been compressed within the chamber 147 of the air spring 94 is exerted against the pistons 140 and 146 mounted on the lower end of the rod 136 to drive the rod 136 toward the position illustrated in FIG. 11. Thus, the valve formed by the valve member 154 and the seating surface 80 is fully opened once an initial opening of such valve has occurred to ensure complete relief of pressure in the well below the pump 20. It will thus be noted that the construction of the pump 20 to position the seating surface 80 adjacent the upper end 38 of the pump body 36 and the direct mounting of the valve member 154 on the rod 136, the element of the pump 20 to be contacted by the wellhead 28, will result in complete relief of gas pressure below the pump 20 when the pump 20 reaches the wellhead 28. Additionally, the support of the rod 136 by the guide tube 87, the seal and retainer ring 122 and the pistons 140 and 146 to ensure axial alignment of the rod 136 guards against jamming of the rod 136 that might otherwise prevent complete relief of gas pressure below the pump 20 when the pump 20 reaches the wellhead 28. Should jamming nevertheless occur; for example, by wear or by grit lodging in bearing surfaces in the pump 20, pressure below the pump 20 can be easily and safely relieved so that the pump 20 can be removed from the wellhead for repair. Specifically, should the pump 20 become jammed at the wellhead 28, the catcher (not shown) can be engaged with the grooves 89 in the guide tube 87 and the plug 35 in the wellhead 28 can be removed to permit a sharp blow to be delivered to the rod 136 via a tool inserted into the wellhead 28. The blow to the rod 136 will open the valve formed by the valve element 154 and the seating surface 80 so that gases can escape through the pump body 36 from the wellhead 28 and the wellhead 28 can then be removed to repair the pump 20.

Figure 13:
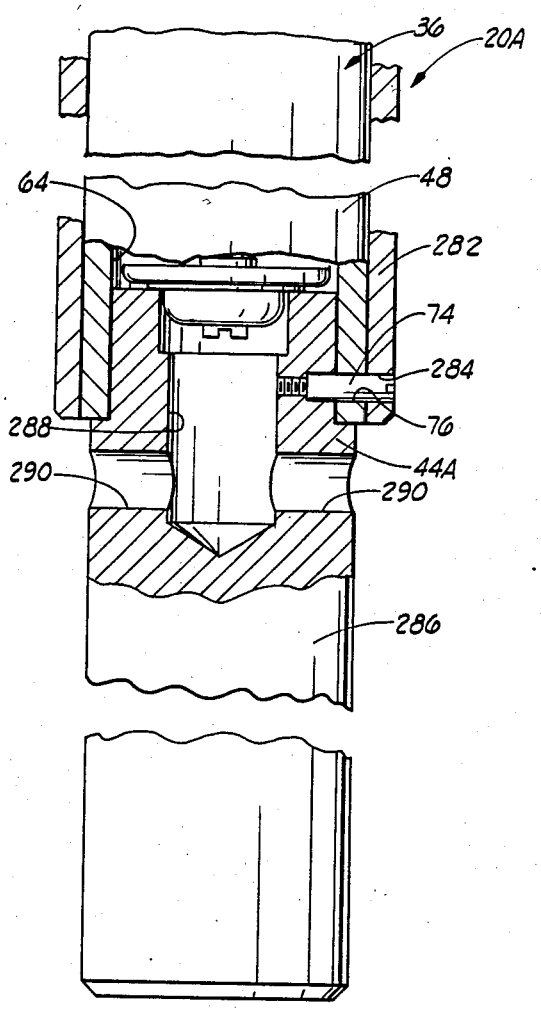
FIG. 13 is a fragmentary elevation in partial cutaway of lower portions of the pump illustrating a modification of lower end portions of the pump body.

Description of FIG. 13

FIG. 13 illustrates a modification, designated 20A, of the casing pump to provide further control of the rate of descent of the pump through the well 22. In particular, FIG. 13 illustrates two methods for increasing the weight of the pump to provide for an increased rate of descent of the pump once the pump has entered liquid in the bottom of the well 22. To this end, the pump 20A is provided with a sleeve 282 that fits about the barrel 48 of the pump body 36 and is secured to the barrel 48 by means of the screws 74 that secure the body plug, designated 44A in FIG. 13, within the bore 64 of the barrel 48. Specifically, the sleeve 282 is secured by forming holes 284 through the wall thereof in alignment with the holes 76 formed through the barrel 48. The sleeve 282 is then secured to the barrel 48 by providing the screws 74 with a lengthened shank that will extend into the holes 284 and fix the sleeve 282 on the barrel 48.

Alternatively, or additionally, the weight of the pump 20A can be increased by modifying the body plug that fits into the bore 64 of the barrel 48. To this end, an extension 286 is formed integrally on the plug 44A so that the weight of the pump 20A can be selected by selecting the length of the extension 286. In this embodiment of the pump, portions of the pump body bore formed through the body plug 44A, designated 288 in FIG. 13, are fluidly communicated with the well by lateral bores 290 that extend from the bore 288 to the outer periphery of the plug 44A. The pump 20A operates in the same manner as the pump 20.

Figure 14:
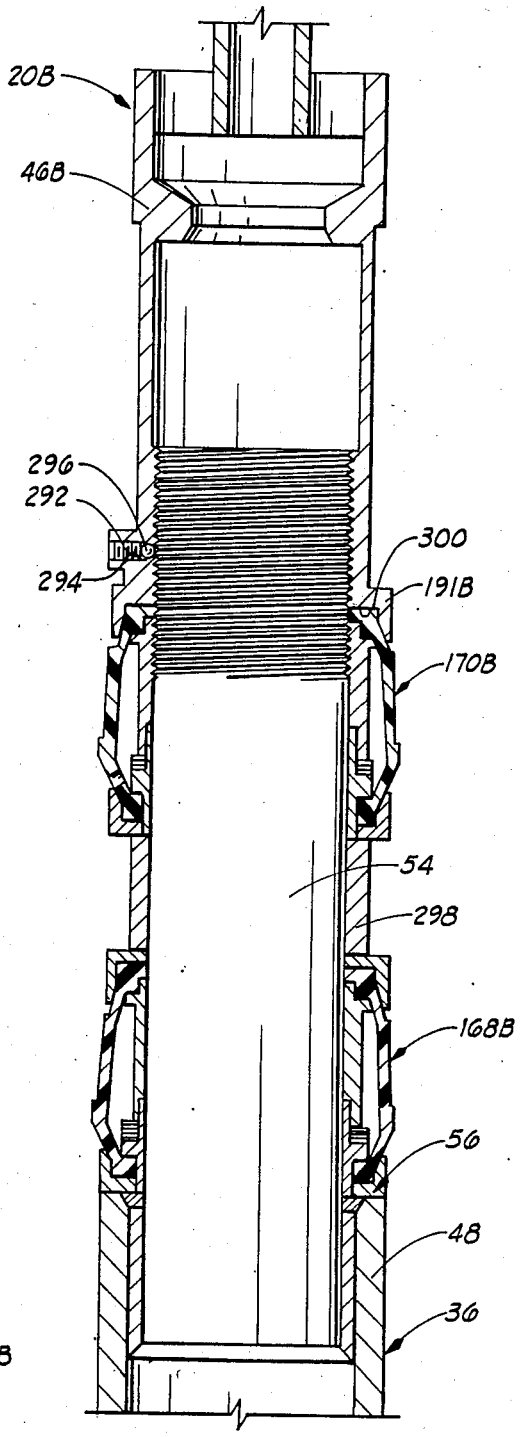
FIG. 14 is a fragmentary cross section in side elevation illustrating a modification of upper portions of the pump.
Figure 15:
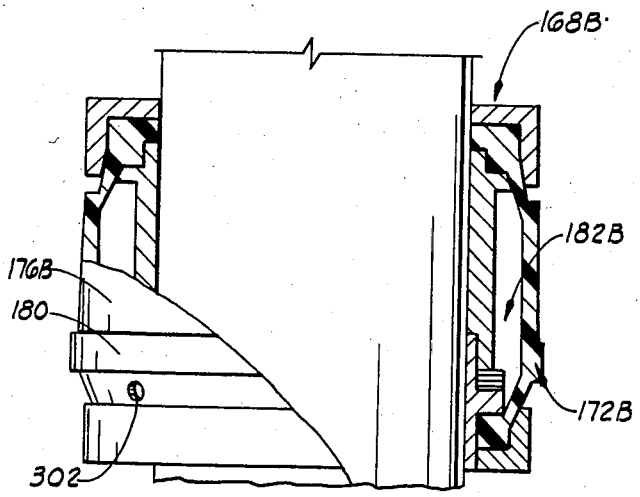
FIG. 15 is an enlarged side elevation in partial cross section of a seal assembly of the pump shown in FIG. 13.

Description of FIGS. 14 and 15

FIGS. 14 and 15 illustrate a modification of upper portions of a pump, designated 20B in FIG. 14, that simplifies the construction of the cap, 46B in FIG. 14, and the seal assemblies 168B and 170B. In the pump 20B, the upper retainer ring 191B of the seal assembly 170B is formed integrally with the cap 46B and the cap 46B is secured to the tubular extension 54 via a set screw 292 located in a bore 294 formed through the wall of the cap 46B. A nylon ball 296 disposed in the bore 294 between the set screw 294 and the tubular extension 54 is driven into the extension 54 by the set screw 292 to securely lock the cap 46B against rotation on the extension 54. In order that the seating surface 80 have an adjustable height in the pump 20B without loss of the capture of the end portions of the seal members of the seal assemblies in the pump 20B, a spacer 298 is mounted on the tubular extension 54 between the seal assemblies 168B and 170B and the length of the spacer 298 is selected so that the combined length of the seal assemblies 168B and 170B and the spacer 298 will equal the distance between the shoulder 56 on the barrel 48 of the pump body 36 and an annular surface 300 formed at the lower end of the combined cap 46B and retainer ring 191B for the seal assembly 170B.

In order to introduce fluid pressure from below the pump 20B into the seal assemblies 168B and 170B, while permitting the positions of the seal assemblies 168B and 170B to be adjusted on the tubular extension 54, the seal assemblies 168B and 170B are provided with a structure that differs slightly from the structure of the seal assemblies 168 and 170 of the pump 20. As shown in FIG. 15 for the modified seal assembly 168B, the seal assembly 168B is comprised of an elastomeric seal member 172B which differs from the seal member 172 of the pump 20 only in that a hole 302 is formed through the central portion 176B of the seal member 172B below the seating surface 180 thereon. Remaining elements of the seal assembly 168B are substantially the same as corresponding elements of the seal assembly 168. Thus, fluid pressure below the pump 20B is transmitted upwardly about the barrel 48 to enter the cavity 182B in the seal assembly 168B via the hole 302 to force the seating surface 180 against the interior of the casing 24 of the well 22. The pump 20B operates in the same manner as the pump 20.

It will be clear that the present invention is well adapted to carry out the objects and attain the ends and advantages mentioned as well as those inherent therein. While presently preferred embodiments of the invention have been described for purposes of this disclosure, numerous changes may be made which will readily suggest themselves to those skilled in the art and which are encompassed within the spirit of the invention disclosed and is defined in the appended claims.

What is claimed is:

1. A natural gas operated pump for use in the casing of an oil well, comprising:

a tubular pump body having an open lower end for admitting well fluids to the interior of the pump body and an open upper end, wherein a downwardly facing seating surface is formed on the inner periphery of the pump body adjacent the upper end thereof;

means for forming a seal between the pump body and the casing of the well;

a rod extending longitudinally through the seating surface formed in the pump body and protruding from the upper end of the pump body;

a valve member mounted on the rod below the seating surface and shaped to mate with the seating surface; and means for vertically positioning the rod in proportion to fluid pressure within the pump body.

2. The pump of claim 1 wherein the rod has a plurality of circumferential grooves formed in the periphery thereof and wherein the valve member comprises:

a split ring; and means for clamping the split ring in a groove of the rod.

3. The pump of claim 1 wherein the pump body comprises:

a tubular base member extending upwardly from the lower end of the pump body and having external threads formed on upper portions thereof; and a tubular cap having internal threads formed therein for screwing the cap onto the base member; and wherein the seating surface is formed on the cap whereby the seating surface can be vertically positioned within the pump body for adjusting the pressure at which the valve member mates with the seating surface.

4. The pump of claim 3 wherein the rod has a plurality of circumferential grooves formed in the periphery thereof and wherein the valve member comprises:

a split ring; and means for clamping the split ring in a groove of the rod.

5. The pump of claim 2 wherein the base member has an external, upwardly facing shoulder formed on the outer periphery thereof and the cap has an annular lower face opposing the shoulder; wherein the means for forming a seal between the pump body and the casing of the well comprises at least one seal assembly encircling the base member above the shoulder for support of the seal assembly by the shoulder, each seal assembly comprising:

an annular, elastomeric seal member having end portions encircling the base member and a tubular central portion connecting the end portions;

a seal adjustment ring constructed of a rigid material, the seal adjustment ring encircling the base member within the seal member and engaging the end portions of the seal member; and two retainer rings encircling the base member, one retainer ring at each end of the seal member and each retainer ring having a tubular flange encircling the end of the seal member adjacent the retainer ring; and wherein the pump further comprises a spacer ring encircling the base member above the shoulder, the spacer ring having a length selected with respect to the position of the cap on the base member such that the length of the combination of the spacer ring and seal assemblies on the base member is equal to the distance separating the shoulder on the base member and face on the lower end of the cap.

6. The pump of claim 5 wherein the central portion of the seal member of each seal assembly is bulged radially outwardly to form an annular chamber extending about the pump body; wherein a cylindrical seating surface is formed on the central portion of the seal member of each seal assembly to engage the casing of the well; and wherein a hole is formed through the central portion of the seal member of each seal assembly below the seating surface thereon to transmit fluid pressure below the seal assembly to the chamber within the seal member thereof.

7. The pump of claim 5 wherein the spacer ring is positioned immediately below the cap whereby each seal assembly is positioned at a fixed vertical level on the base member; wherein the central portion of the seal member of each seal assembly is bulged radially outwardly to form an annular chamber within the seal assembly; wherein a groove is formed in the inner periphery of each seal adjustment ring; wherein a hole is formed through the seal adjustment ring of each seal assembly to intersect the groove and open to the annular chamber within the seal assembly; and wherein a hole is formed through the wall of the base member at a level of the groove of the seal adjustment ring for each seal assembly to transmit fluid pressure within the base member to the chambers within the seal assemblies.

8. The pump of claim 1 wherein the pump is further characterized as being of the type that is dropped into a well for subsequent raising by natural gas pressure in the wall; and wherein the pump further comprises braking means for slowing the rate of descent of the pump at such times that the pump falls through gases in the well.

9. The pump of claim 8 wherein the pump body is characterized as having an axial pump body bore through which well fluids pass at such times that the pump falls in the well; wherein an internal shoulder is formed in the pump body bore; and wherein the braking means comprises:

a brake body mounted in the pump body bore above the shoulder, the brake body having a cavity formed in the lower end thereof facing the shoulder and a tapered outer periphery enlarging toward the lower end of the brake body to form an annular flow passage, having a constricted portion near the lower end of the brake body, between the brake body and the pump body bore; and brake valve means, comprising:

a valve plate located between the brake body and shoulder for movement between an upper position wherein the valve plate overlays the cavity in the brake body and a lower position wherein the valve plate engages the shoulder; and means for urging the valve plate against the shoulder;

wherein the brake body is further characterized as comprising means for fluidly communicating the cavity formed therein with the constricted portion of the flow passage in the upper position of the valve plate.

10. The pump of claim 9 wherein the brake valve means further comprises a cup attached to the underside of the valve plate to enter portions of the pump bore below the shoulder therein in the lower position of the valve plate.

11. The pump of claim 9 further comprising a sleeve mounted on the pump body to extend circularly thereabout for adjusting the weight of the pump.

12. The pump of claim 9 wherein the pump body is characterized as comprising:

a tubular base member; and a plug mounted in the bore of the base member and extending longitudinally from one end of the pump body, the plug having a plug bore formed in portions thereof within the base member to form a portion of the pump body bore and lateral bores intersecting the plug bore and opening to the well for fluid communication between the well and interior portions of the pump body;

wherein the plug bore is formed on a reduced diameter to form the shoulder in the bore through the pump body; and wherein the plug is characterized as having a cylindrical extension formed on portions thereof exterior to the pump base member, whereby the length of the extension can be selected for adjusting the weight of the pump.

13. The pump of claim 8 wherein the pump body comprises:

a tubular base member extending upwardly from the lower end of the pump body and having external threads formed on upper portions thereof; and a tubular cap having internal threads formed therein for screwing the cap onto the base member; and wherein the seating surface is formed on the cap whereby the seating surface can be vertically positioned within the pump body for adjusting the pressure at which the valve member mates with the seating surface.

14. The pump of claim 13 wherein the base member has an external, upwardly facing shoulder formed on the outer periphery thereof and the cap has an annular lower face opposing the shoulder; wherein the means for forming a seal between the pump body and the casing of the well comprises at least one seal assembly encircling the base member above the shoulder for support of the seal assembly by the shoulder, each seal assembly comprising:

an annular, elastomeric seal member having end portions encircling the base member and a tubular central portion connecting the end portions;

a seal adjustment ring constructed of a rigid material, the seal adjustment ring encircling the base member within the seal member and engaging the end portions of the seal member; and two retainer rings encircling the base member, one retainer ring at each end of the seal member and each retainer ring having tubular flanges encircling the end of the seal member adjacent the retainer ring; and wherein the pump further comprises a spacer ring encircling the base member above the shoulder, the spacer ring having a length selected with respect to the position of the cap on the base member such that the length of the combination of the spacer ring and seal assemblies on the base member is equal to the distance separating the shoulder on the base member and face on the lower end of the cap.

15. A seal assembly for forming a seal between a tubular body of a natural gas operated pump inserted in a well and the casing of the well, comprising:

an annular, elastomeric seal member mounted on the pump body and having end portions encircling the pump body, the seal member having a tubular central portion connecting the end portions and bulging radially outwardly to form an annular chamber extending about the pump body; and a seal adjustment ring within the chamber formed about the pump body, the seal adjustment ring encircling the pump body and engaging the end portions of the seal member;

wherein the seal adjustment ring is split into two coaxial, spaceable elements for varying the separation of the end portions of the seal member to thereby adjust the diameter of the central portion of the seal member.

16. The seal assembly of claim 15 further comprising two retainer rings encircling the pump body at opposite ends of the seal member, each retainer ring having a tubular flange encircling the end portion of the seal member adjacent the retainer ring.

17. The seal assembly of claim 15 wherein a seating surface shaped to conform to a cylindrical surface is formed on the central portion of the seal member; and wherein a hole is formed through the central portion of the seal member to one side of the seating surface for transmitting fluid pressure in the well to the chamber about the pump body.

18. The seat assembly of claim 15 for use with a pump having a hole formed through the wall of the tubular body thereof wherein a seating surface shaped to conform to a cylindrical surface is formed on the central portion of the seal member; wherein a groove is formed in the inner periphery of the seal adjustment ring for alignment with the hole formed through the wall of the tubular pump body; and wherein a hole intersecting said groove and opening to the chamber about the pump body is formed through the seal adjustment ring for transmitting fluid pressure within the pump body to said chamber.

19. In a pump of the type that is dropped into a well for subsequent raising by natural gas pressure and comprising a tubular pump body having an axial pump body bore through which well fluids pass at such times that the pump falls in the well, the improvement wherein an internal shoulder is formed in the pump body bore and wherein the pump further comprises:

a brake body mounted in the pump body bore above the shoulder, the brake body having a cavity formed in the lower end thereof facing the shoulder and a tapered outer periphery enlarging toward the lower end of the brake body to form an annular flow passage, having a constricted portion near the lower end of the brake body, between the brake body and the pump body bore; and brake valve means, comprising:

a valve plate located between the brake body and shoulder for movement between an upper position wherein the valve plate overlays the cavity in the brake body and a lower position wherein the valve plate engages the shoulder; and means for urging the valve plate against the shoulder;

wherein the brake body is further characterized as comprising means for fluidly communicating the cavity formed therein with the constricted portion of the flow passage in the upper position of the valve plate.

20. The pump of claim 19 wherein the brake valve means further comprises a cup attached to the underside of the valve plate to enter portions of the pump bore below the shoulder therein in the lower position of the valve plate.

21. The pump of claim 19 further comprising a sleeve mounted on the pump body to extend circularly thereabout for adjusting the weight of the pump.

22. The pump of claim 19 wherein the pump body is characterized as comprising:

a tubular base member; and a plug mounted in the bore of the base member and extending longitudinally from one end of the pump body, the plug having a plug bore formed in portions thereof within the base member to form a portion of the pump body bore and lateral bores intersecting the plug bore and opening to the well for fluid communication between the well and interior portions of the pump body;

wherein the plug bore is formed on a reduced diameter to form the shoulder in the bore through the pump body; and wherein the plug is characterized as having a cylindrical extension formed on portions thereof exterior to the pump base member, whereby the length of the extension can be selected for adjusting the weight of the pump.

* * * * *